US006128798A

United States Patent [19]

Barman et al.

[11] Patent Number: 6,128,798

[45] Date of Patent: Oct. 10, 2000

[54] CAVITATED PAD AND INNERSPRING ASSEMBLY COMBINATION HAVING SPRINGS WITH FREE TERMINAL CONVOLUTIONS

[75] Inventors: Bruce G. Barman, Greensboro, N.C.; Said A. Dimitry, Westlake, Ohio

[73] Assignee: Sealy Technology LLC

[21] Appl. No.: 09/148,248

[22] Filed: Sep. 4, 1998

[51] Int. Cl.[7] ..... A47C 23/04

[52] U.S. Cl. ..... 5/716; 5/654.1; 5/654.7

[58] Field of Search ..... 5/716, 654.1, 655.7, 5/248, 256, 936, 642, 230, 267; 267/91, 94, 142, 143

[56] References Cited

U.S. PATENT DOCUMENTS

| | | | |
|---|---|---|---|
| 912,456 | 2/1909 | Fischman | 5/720 |
| 1,006,295 | 10/1911 | Schultz | 152/298 |
| 2,184,396 | 12/1939 | Mudge . | |
| 2,194,569 | 3/1940 | Rumpf . | |
| 2,196,601 | 3/1940 | Mattison . | |
| 2,272,493 | 2/1942 | Williams . | |
| 2,309,570 | 10/1943 | Borisch | 267/84 |
| 2,540,441 | 2/1951 | Gordon | 5/720 |
| 2,585,415 | 2/1952 | Toms . | |
| 2,882,959 | 4/1959 | Burkart | 267/84 |
| 3,099,844 | 8/1963 | Bolesky . | |
| 3,145,020 | 8/1964 | Calla . | |
| 4,862,540 | 9/1989 | Savenije | 5/655.7 |
| 4,956,884 | 9/1990 | Hwang . | |
| 5,327,596 | 7/1994 | Wallace et al. . | |
| 5,713,088 | 2/1998 | Wagner et al. . | |

*Primary Examiner*—Terry Lee Melius
*Assistant Examiner*—Fredrick Conley
*Attorney, Agent, or Firm*—Arter & Hadden LLP

[57] ABSTRACT

A cavitated pad and innerspring assembly combination, for use in mattresses, furniture, or other cushioned flexible support structures, wherein coils of the innerspring assembly have terminal convolutions which extend beyond the coil body and are not connected to adjacent coils. A cavitated pad has openings in which the terminal convolutions fit, and the pad overlies the coil bodies. In one embodiment, the cavitations extend either partially or entirely through the pad. Upholstery is attached over the pad. The combination of coils with terminal convolutions positioned within the cavitations in the pad provides a dampened or attenuated dual spring rate support surface with controlled lateral deflection of the terminal convolutions.

16 Claims, 5 Drawing Sheets

CAVITATED PAD AND INNERSPRING ASSEMBLY COMBINATION HAVING SPRINGS WITH FREE TERMINAL CONVOLUTIONS

FIELD OF THE INVENTION

The present invention relates to a novel pad and innerspring assembly combination for construction of cushioned flexible support surfaces such as mattresses and furniture.

BACKGROUND OF THE INVENTION

Innerspring assemblies are conventionally made from arrays of vertically-oriented coil springs (i.e., the longitudinal axes of the typical helical springs are perpendicular to the innerspring support surface). The springs are arranged in a generally side-by-side arrangement, usually in parallel columns and parallel rows, to form a support surface. To secure the individual spring coils together and form a unitary innerspring assembly, some form of attachment means is normally employed, such as clips or a cross-helical lacing wire. Most commonly, the springs are attached together at their terminal convolutions, i.e., the metal turn at the very top and bottom of the springs. See, for example, Bell, U.S. Pat. No. 2,611,910, and Flesher et al., U.S. Pat. No. 4,726,572. This creates a planar surface over the ends of the coils over which foam and upholstery is laid.

A recently developed new type of coil, as described in commonly assigned U.S. Pat. No. 5,713,088, has a helical coil body with "terminal convolutions" which extend from one or both ends of the coil body. The terminal convolutions are also helical, with a radius less than that of the coil body. These type of coils are secured or laced together in an innerspring by attachment at the coil heads, located between the coil body and terminal convolution. The terminal convolutions are thus free to compress and laterally deflect. One particular advantage of this type of coil is that it provides a dual spring rate, with the terminal convolution providing an initial relatively soft spring force, and then compresses fully upon the body of the coil which provides a relatively firmer spring force. The extent of lateral deflection of the terminal convolutions is perceptible, particularly upon initial loading. Traditional planar type padding laid over the top of the terminal convolutions tends to dampen the advantageous dual spring rate feel of an innerspring constructed with these types of coils.

In most flexible support surfaces such as mattresses and furniture, internal pads are laid over the top supporting surface of innerspring assemblies to provide soft cushioning in addition to the flexible support provided by the springs. One mattress pad/innerspring assembly design described in U.S. Pat. No. 5,327,596 has a foam cushion having individual, unconnected springs imbedded in the foam cushion. The springs are completely encased in preformed cavities in the foam, or screwed into the cushion body. This type of construction is not practical for conventional innerspring assemblies.

In another mattress pad/innerspring assembly design, shown in U.S. Pat. No. 3,145,020, cylindrical recesses are formed in the mattress pad or cushion. The cylindrical recesses are joined through interconnecting channels formed in the mattress pad. The innerspring assembly is formed into an array which corresponds to the cylindrical recesses in the pads and fit into the pads. Annular protuberances extend through the center of the springs. When fully assembled, the innerspring assembly is completely embedded between the two pads. Although these examples provide various combinations of foam with innersprings, they are rather complex, costly to manufacture, and tend to over-dampen the action of the springs. The prior art does not provide a pad which is specially configured or adapted to integrally fit with innerspring assemblies which have springs with free terminal convolutions.

SUMMARY OF THE INVENTION

A principal objective of the present invention is to provide a novel pad and innerspring combination assembly, particularly for use as an innerspring mattress, but also adaptable for use in any type of cushioned reflexive support structure such as seating and backing.

The pad and innerspring assembly combination of the present invention has in one embodiment first and second pads having a plurality of corresponding cavities disposed on the inner surfaces of the pads. The cavities can be generally dome-shaped or can extend completely through the pads. Each of the cavities is adapted to receive opposing terminal convolutions of coils or springs of an innerspring assembly positioned between the pads. The innerspring assembly has a plurality of individual springs arranged in an array corresponding in location to the cavities in the pads, as described in U.S. Pat. No. 5,713,088.

In one particular embodiment, each individual spring of the innerspring assembly has a coil body, a pair of generally planar offset sections on opposite ends of the coil body, and a pair of terminal sections adjacent to the offset sections. The offset sections have a crown, a border bar, and an open end. The terminal sections are formed by helical convolutions which decrease in diameter near the ends of the spring. The first helical convolution extends slightly over the border bar so that when the terminal section is compressed the first helical convolution touches the border bar. Adjacent springs are joined together at the offset sections using conventional manufacturing techniques. The terminal convolutions of adjacent coils are not connected, and can thus deflect laterally to some extent. Also, the independent terminal convolutions have a different, relatively stiffer, spring rate than the coil body, so that the support surface feels initially soft and then firmer. With the cavitated pad surrounding the terminal convolutions and supported by the offsets on the coil bodies, lateral deflection of the terminal convolutions, and the spring rate differential may be attenuated by selecting foams of differing firmness or densities.

In accordance with one particular aspect of the invention there is provided, in combination, an innerspring having a plurality of interconnected coils with vertical axes of the coils generally parallel and ends of the coils in common planes, each coil having a coil body, at least some of the coils having a terminal convolution which extends from an end of the coil body along the vertical axis of the coil, and an innerspring pad having a plurality of cavitations which correspond in location to the positions of the terminal convolutions of the coils of innerspring, the pad positioned over the coils so that the terminal convolutions extend into the cavitations. The terminal convolutions are generally free to move within the respective cavities.

In accordance with another particular aspect of the invention, a mattress innerspring and pad combination includes an innerspring assembly having a plurality of interconnected coils, each coil having a generally helical body terminating in a coil head, each of the coil heads being interconnected with adjacent coils and positioned in a common plane, each of the coils having a terminal convolution which extends from the coil head, and a cavitated mattress pad which overlies the mattress innerspring and is supported by the coil heads, the cavitated mattress pad having a plurality of cavities which correspond in location to the terminal convolutions of the coils so that the terminal convolutions extend into the cavities with the pad supported by the coil heads.

And in accordance with still another particular aspect of the invention, there is provided pad and innerspring assembly combination which includes an innerspring assembly having a plurality of springs interconnected in an array, each of the springs having a generally helical spring body with offset sections at each end of the body, and a terminal convolution extending from at least one of the offset sections, the terminal convolution having a generally helical shape and a diameter less than a diameter of the spring body, and a cavitated pad positioned to overlie the offset sections of the springs of the innerspring assembly, the cavitated pad having one or more cavities positioned to correspond in location with the terminal convolutions of the springs so that the terminal convolutions are positioned within the cavities.

The foregoing features and advantages of the present invention will be further understood upon consideration of the following detailed description of certain embodiments of the present invention with reference to the accompanying drawings.

DETAILED DESCRIPTION OF PREFERRED AND ALTERNATE EMBODIMENTS

Figure 1:
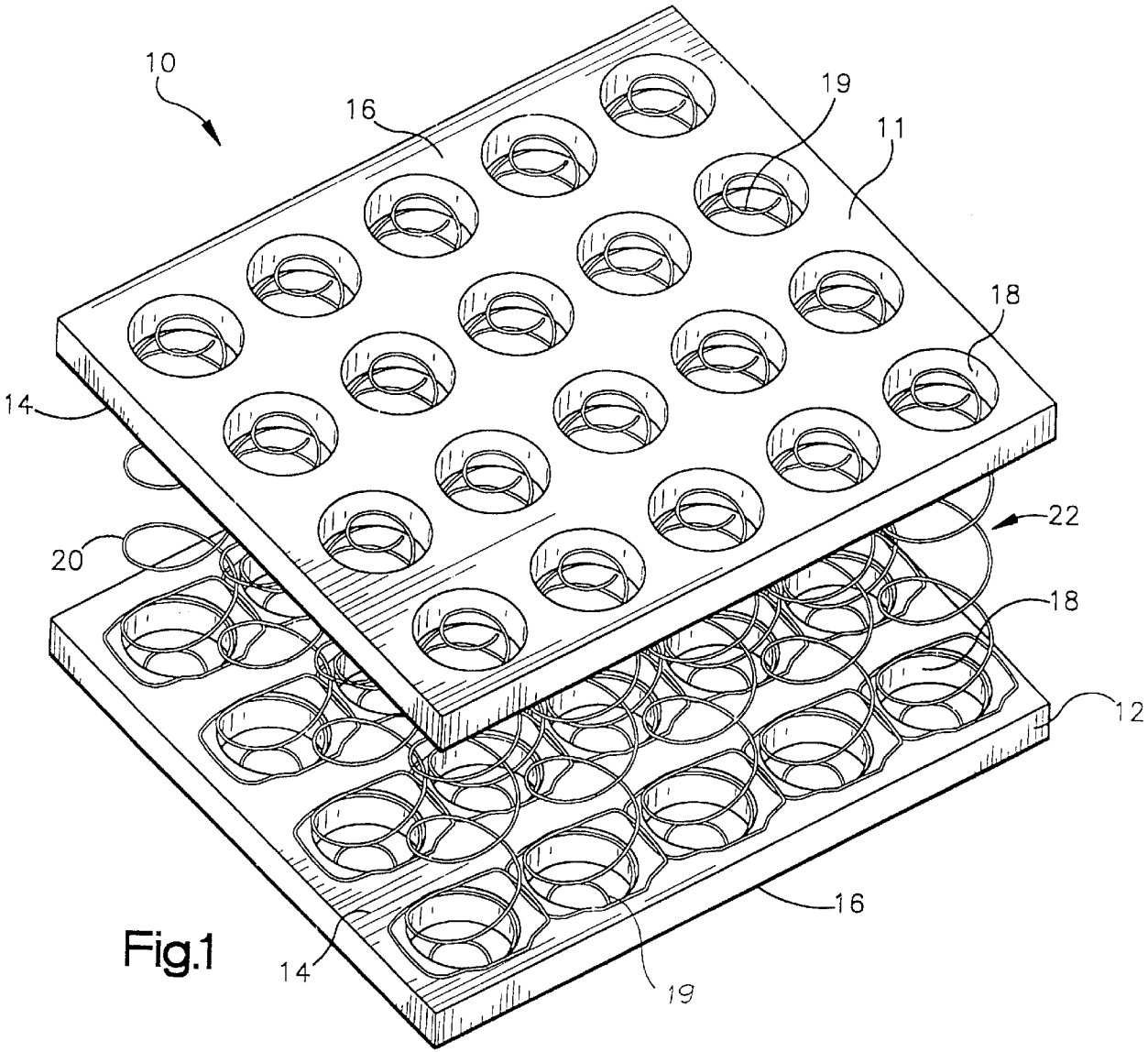
FIG. 1 is a perspective view of one embodiment of the cavitated pad and innerspring assembly combination of the present invention.

Referring to FIG. 1, the mattress pad and innerspring assembly combination of the present invention is shown generally at 10. The combination 10 comprises a first mattress pad 11 and a second mattress pad 12. The pads 11 and 12 are generally rectangular in shape (although other shapes can be constructed for use in non-rectangular structures such as furniture, seating, mattresses or other flexible support structures) and have an inner surface 14 and an outer surface 16. The pads 11 and 12 have a plurality of corresponding cavities 18 disposed therein. As shown in FIG. 1, the cavities 18 extend entirely through the pads 11 and 12. Each of the cavities 18 is dimensioned or otherwise adapted to receive opposing terminal sections 19 of a spring 20.

Figure 2A:
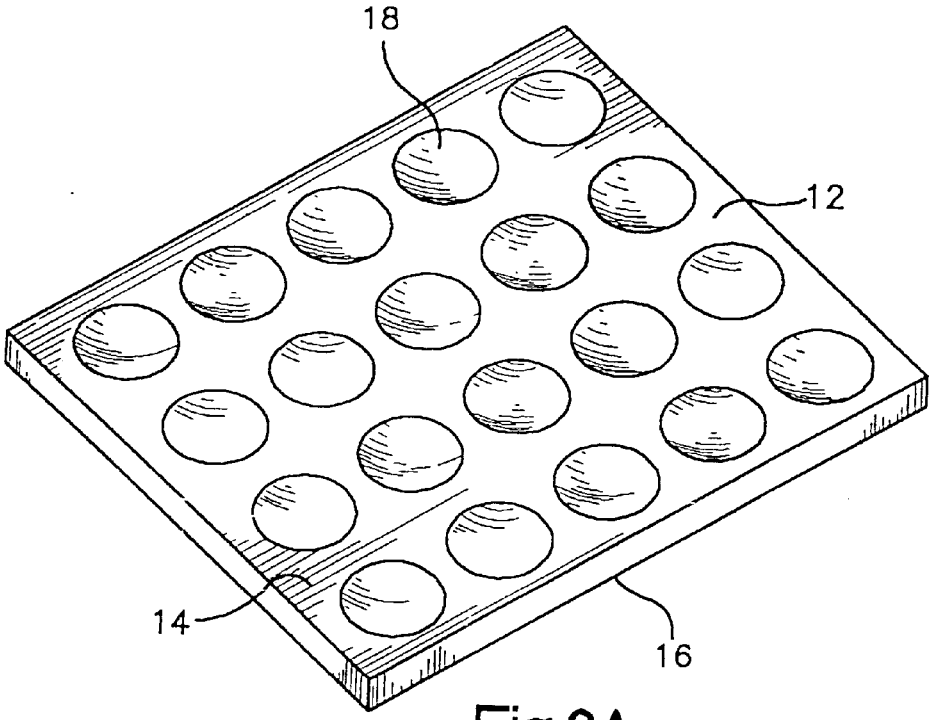
FIG. 2A is a perspective view of one embodiment of a mattress pad of the present invention.
Figure 2B:
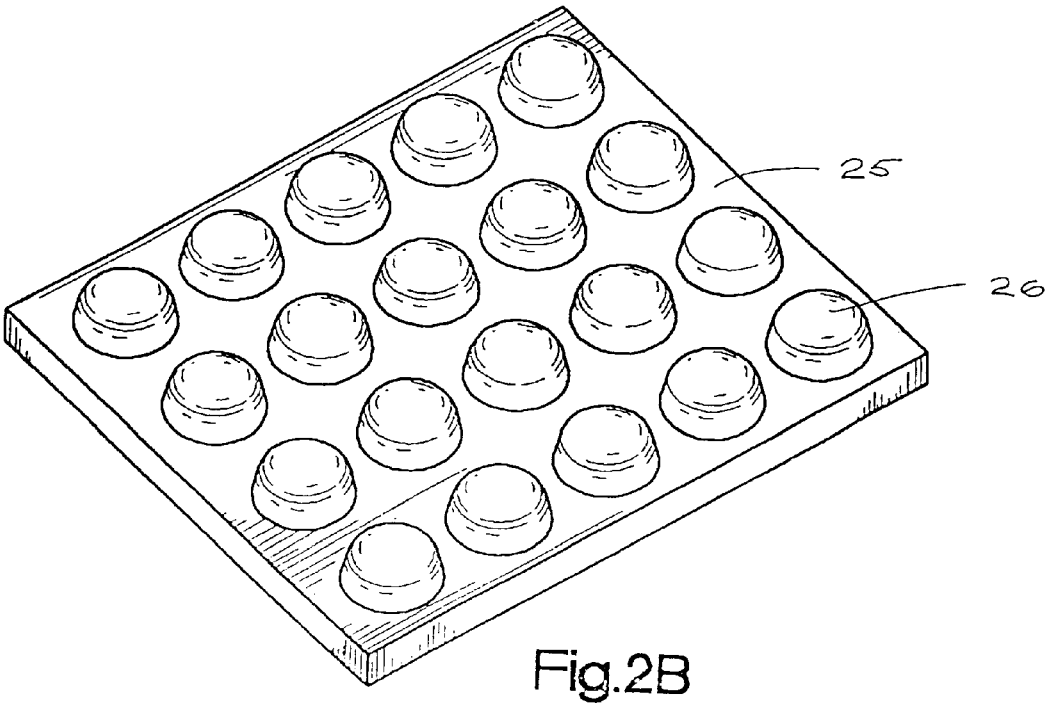
FIG. 2B is a perspective view of a mattress pad of the present invention having the reverse topography of the pad of FIG. 2A.

In an alternate embodiment, the cavities 18 in pads 11 and 12 are generally concave dome-shaped as shown in FIG. 2A. The production of a pad with this particular topography also produces a complimentary pad 25, shown in FIG. 2B, which has a reverse topography of convex domes or moguls 26 which protrude from the pad surface. This reverse surface pad 25 can be used in combination with cavitated pads wherein the domes are aligned with the cavities and terminal convolutions of the coils or springs, as further described below with reference to FIG. 5.

As used herein, the terms "cavities", "cavitated" and "cavitations" refer to any type of opening or void in a pad in which a portion of spring or coil or other reflexive structure may fit. As described, the cavities 18 may extend partially or entirely through the pads 11 or 12. Pads 11 and 12 are preferably made of polyurethane foam, although other materials can also be used. Pads 11 and 12 preferably have about a thickness at least equal to the extent of the terminal convolution 19 beyond the body 30 of coil 20, in the direction of the longitudinal axis of the coil.

As shown in FIG. 1, an innerspring assembly 22 is arranged between the pads 11 and 12. The innerspring assembly 22 is comprised of a plurality of individual coils 20 arranged in a matrix array wherein the terminal convolutions of the coils 20 correspond in location and fit within cavities 18 in pads 11 and 12.

Figure 3A:
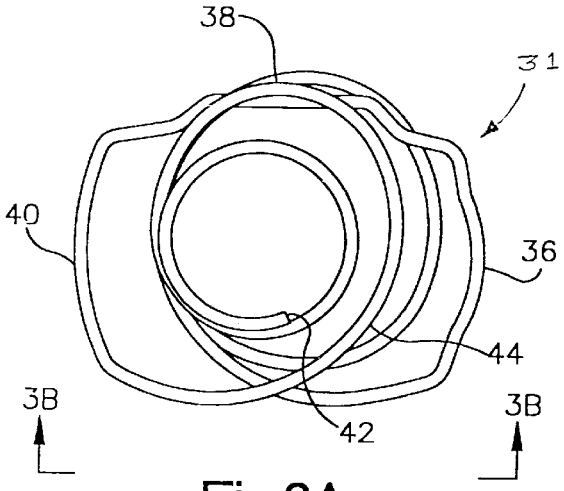
FIG. 3A is a top view of a coil of the innerspring assembly of the present invention.
Figure 3B:
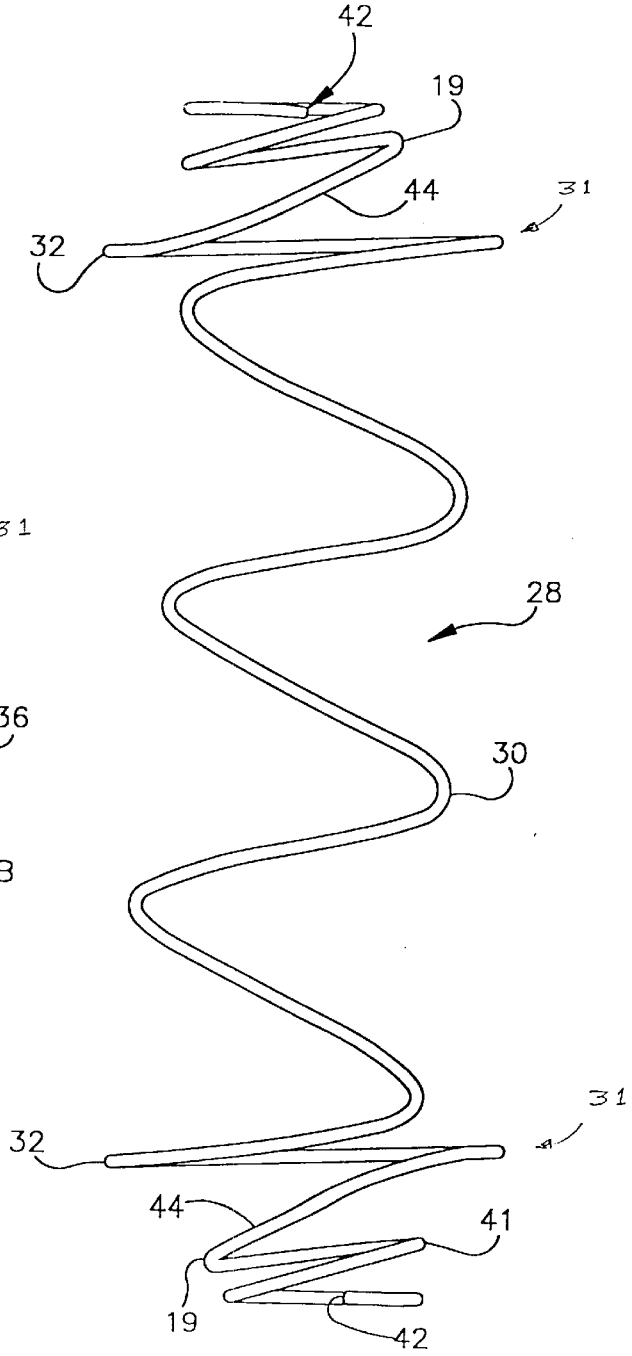
FIG. 3B is a profile view of the spring of the present invention.

Referring to FIGS. 3A and 3B, each individual coil 20 is made of a single, continuous piece of wire stock which is generally helical in configuration. This type of coil is described in U.S. Pat. No. 5,713,088, incorporated herein by reference. The coils 20 include a coil body 28 having at least one helical turn 30, coil heads 31 with offset sections 32 on each end of the coil body 28, and terminal convolutions 19 extending from each of the offset sections 32. Alternatively, this type of coil may be constructed with only one terminal convolution extending from one end of the coil body. As best shown in FIG. 3B, the offset sections 32 include a crown 36, a border bar 38, and an open end 40. The border bar 38 extends generally perpendicularly from the crown 36. The open end 40 extends generally perpendicularly from the border bar 38 and is generally parallel to the crown 36. The terminal sections 19 are comprised of at least one generally helical convolution 41. The helical convolutions 41 of the terminal sections 19 decrease in diameter toward an endpoint 42. The first helical convolution 44 of the terminal convolution 19 extends slightly over the border bar 38 so that when the terminal convolution 19 is compressed, the first helical convolution 44 comes in contact with the border bar 38. The described coils 20 have a dual spring rate, with the terminal convolution 19 having one spring rate, and the coil body 28 having a second spring rate different than that of the terminal convolution.

Figure 4:
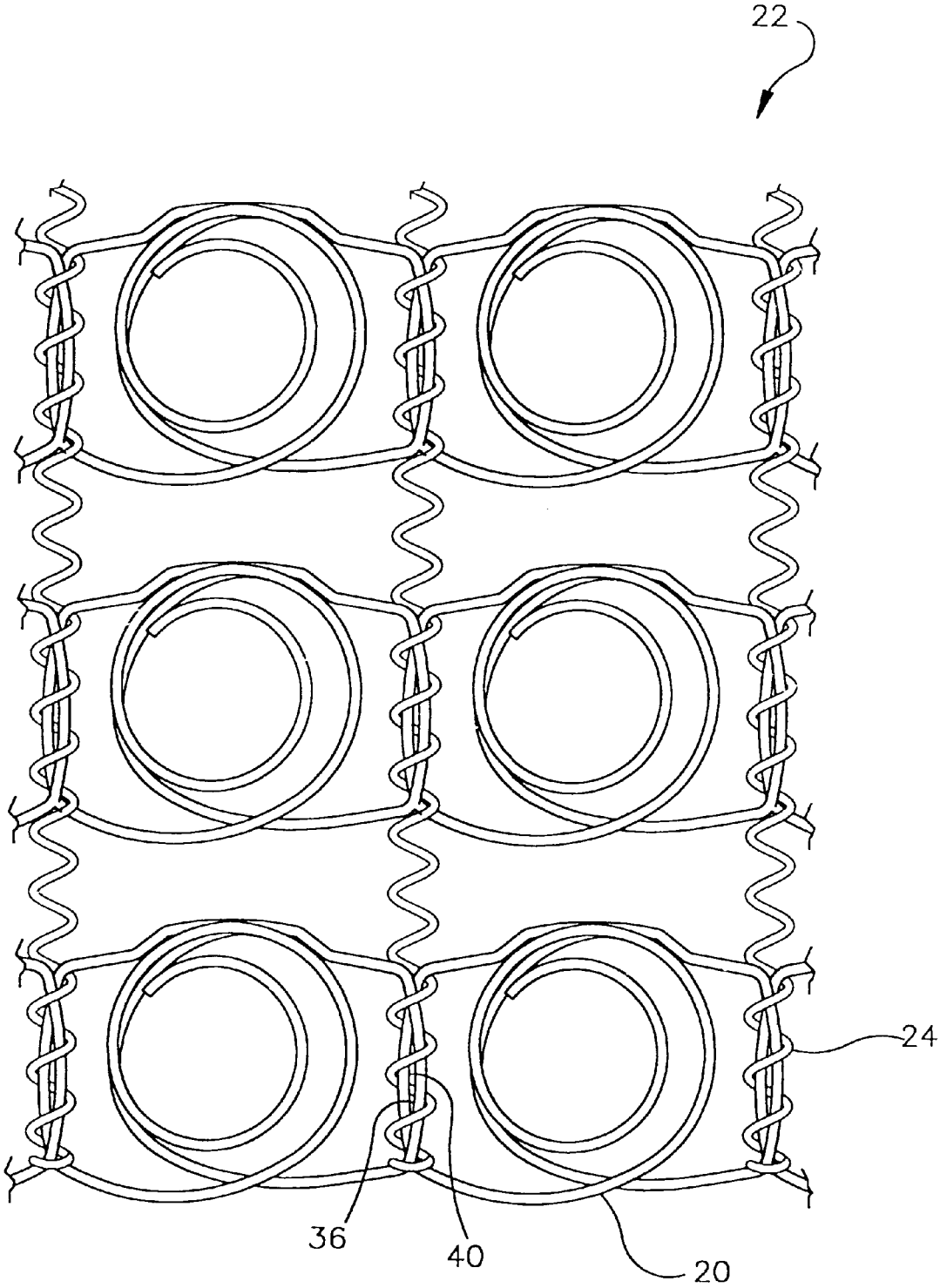
FIG. 4 is a top view of one embodiment of the innerspring assembly of the present invention.

As shown in FIG. 4, the coils 20 of the innerspring assembly 22 can be secured together with helical wire 24 into a generally orthogonal array to form the innerspring assembly 22. The helical wire 24 is wrapped around the crown 36 and the open end 40 of adjacent springs 20, securing together the coils 20 of the innerspring assembly 22. The terminal convolutions 19, however, are not directly connected to any other coil and thus have a wide degree of freedom of motion/deflection relative to the corresponding coil body.

Figure 5:
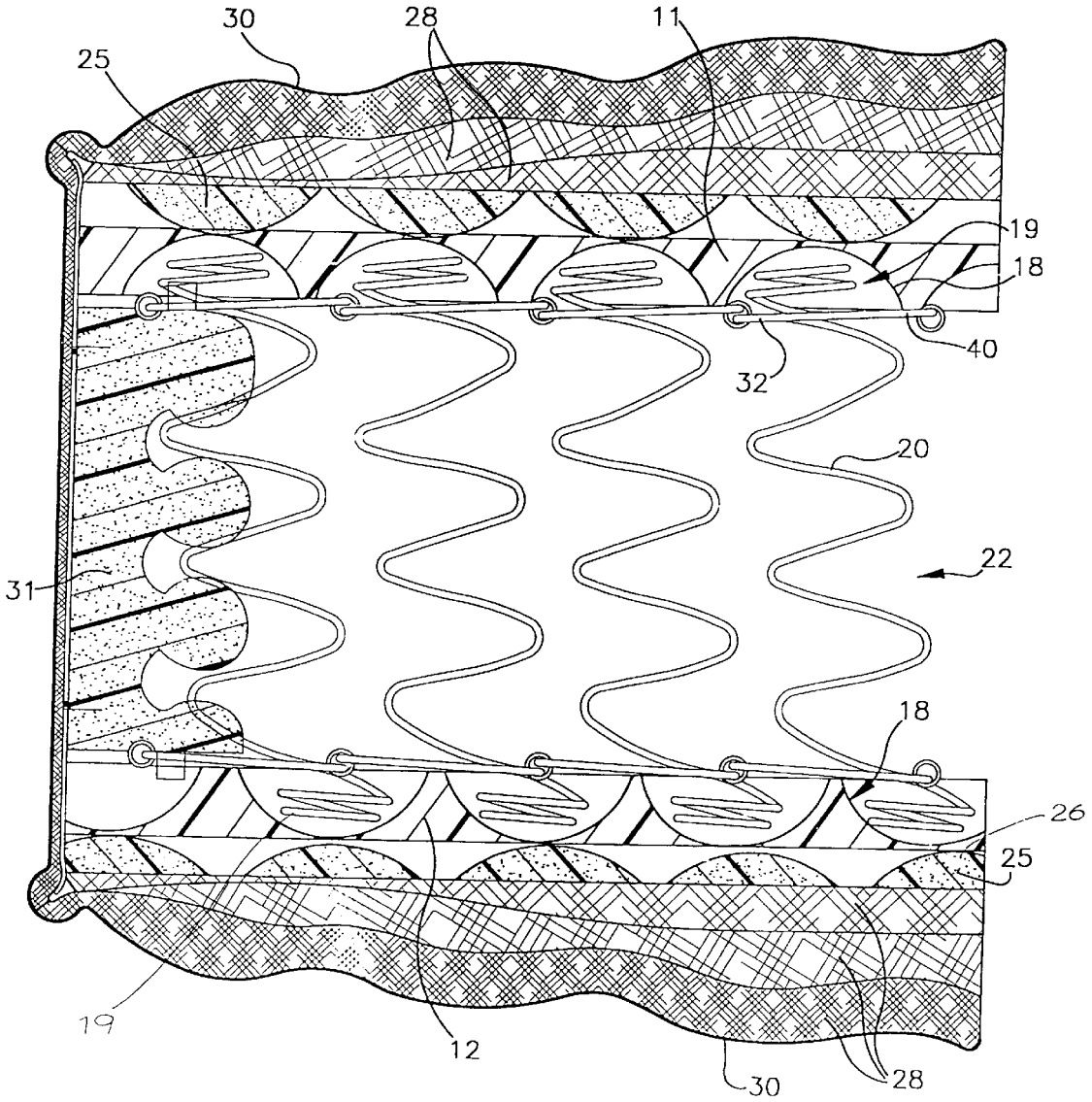
FIG. 5 is a cross-sectional view of a mattress incorporating the cavitated pad and innerspring assembly combination of the present invention.

As further shown in FIG. 5, the array of the innerspring assembly 22 corresponds with the cavities 18 in pads 11 and 12. The innerspring assembly 22 is arranged between the pads 11 and 12 so that each terminal convolution 19 extends into a cavity 18 in the pads 11 and 12, and the offset sections 32 are in contact with the inner surface 14 of the pads 11 and 12. By this construction, the offset sections 32 provide a support structure for the pads 11 and 12, and compressive forces on the pads are absorbed both by the offsets 32 and by the terminal convolutions 19. Furthermore, the discrete encapsulation of each of the terminal convolutions 19 in the cavities 18 dampens the degree of lateral deflection of the terminal convolutions in response to forces applied obliquely to the innerspring assembly or mattress surface.

The combination of the present invention can be used to make padded innerspring assemblies of any type. As further shown in FIG. 5, a secondary pad 25, which has a contoured surface with domes or moguls 26 which correspond in shape to the cavities of pads 11 and 12, and can be positioned over the exterior side of pads 11 and 12 as shown. The secondary padding layer 25 is preferably the by-product of the manufacture of the layers 11 and 12 with concave dome-shaped cavities 18 shown in FIG. 2A. This arrangement increases the amount of foam positioned directly over the terminal convolutions 19 to obscure tactile projection of the coils and increase the comfort of the structure. Quilting layers 28 and upholstery layers 30 are attached over pads 11 and 12 to complete the assembly. The pads 11 and 12 may also be combined with other types of internal support structures such as side support 31 which engages the coils around the perimeter of the innerspring and has top and bottom edges on which the pads lie.

The invention thus provides a novel innerspring and pad combination which utilizes dual spring rate coils with terminal convolutions which are fully encapsulated in the assembly. With the foregoing description in mind, however, it is understood that this description is made only by way of example, that the invention is not limited to the particular embodiments described herein, and that various rearrangements, modifications and substitutions may be implemented without departing from the true spirit of the invention as hereinafter claimed. For example, other types of coils, which may or may not be helical in shape, and/or coils with different types of terminal convolutions or "tails" which project from a main coil body may be used in accordance with the invention. Also, pads with cavitations or openings of different configurations than those expressly described are also within the scope of the invention. The combination of cavitated pads with innersprings assemblies having coils with portions which extend from the body of the coil into cavities in the pads is applicable to any type of flexible support surface including, without limitation, furniture, bedding and seating.

What is claimed is:

1. In combination, an innerspring having a plurality of interconnected coils with vertical axes of the coils generally parallel and ends of the coils in common planes, each coil having a coil body, offset sections on each end of the coil body which extend laterally beyond the coil body, and a terminal convolution which extends from the offset sections, an innerspring pad having a plurality of cavitations which correspond in location to locations of the terminal convolutions of the coils of innerspring, the innerspring pad positioned over and in contact with the offset sections of the coils so that the terminal convolutions are positioned within the cavitations of the innerspring pad.

2. The combination of claim 1 wherein the coil body of the coils of the innerspring has an offset section with a radial extent from the vertical axis of the coil greater than a radial extent of the terminal convolution from the vertical axis of the coil.

3. The combination of claim 1 wherein the cavitations of the innerspring pad extend partially through the pad.

4. The combination of claim 1 wherein the cavitations of the innerspring pad extend entirely through the pad.

5. The combination of claim 3 wherein the cavitations of the innerspring pad are generally dome-shaped.

6. The combination of claim 5 in combination with a pad which overlies the innerspring pad, and which has a plurality of domes which correspond in shape with the cavitations of the innerspring pad.

7. A mattress innerspring and pad combination comprising an innerspring assembly having a plurality of interconnected coils, each coil having a generally helical body terminating in a coil head, each of the coil heads being interconnected with adjacent coils and positioned a common plane, each of the coils having a terminal convolution which extends from the coil head, a portion of the coil heads extending outside of the helical bod, a cavitated mattress pad which overlies the mattress innerspring and is supported by the coil heads, the cavitated mattress pad having a plurality of cavities which correspond in location to the terminal convolutions of the coils so that the terminal convolutiosn extend into the cavities with the pad supported by the coil heads.

8. The mattress innerspring and pad combination of claim 7 in combination with a second pad having a surface contour which corresponds with a pattern of cavities in the cavitated mattress pad.

9. The mattress innerspring and pad combination of claim 7 wherein coils of the innerspring assembly have a coil head with a terminal convolution which extends from the coil head at each end of the coil body, and a cavitated mattress pad over each end of the coils.

10. A pad and innerspring assembly combination comprising:

an innerspring assembly having a plurality of springs interconnected in an array, each of the springs having a generally helical spring body with offset sections at each end of the body, the offest sections having a portion which extends laterally beyond the spring body, and a terminal convolution extending from the offset sections, the terminal convolutions having a generally helical shape and a diameter less than a diameter of the spring body, a cavitated pad positioned to contact the offset sections of the springs of the innerspring assembly, the cavitated pad having one or more cavities positioned to correspond in location with the terminal convolutions of the springs so that the terminal convolutions are positioned within the cavities.

11. The pad and innerspring assembly combination of claim 10 combined with a secondary pad having contours which correspond generally in shape to the cavities of the cavitated pad, the secondary pad positioned adjacent the cavitated pad with projecting portions of the secondary pad corresponding in location to the cavities of the cavitated pad.

12. A cavitated pad for use in combination with an innerspring assembly having a plurality of interconnected coils, the coils having a coil body, a coil head at one end of the coil body, the coil head having an offset section at least a portion of which extends laterally outside of the coil body, and a terminal convolution which extends from the coil head within a radial extent of the coil body and coil head, the cavitated pad comprising a thickness approximately at least equal to a height of the terminal convolution above the offset section, and cavities located to correspond with the locations of the terminal convolutions of the coils of the innerspring assembly when the pad is placed upon the innerspring assembly and in contact with the offset sections of the coils.

13. A mattress assembly comprising:

an innerspring assembly having a plurality of interconnected coils, each of the coils of the innerspring assembly having a coil body, a coil head at each end of the coil body, and a terminal convolution which extends from each coil head, the terminal convolution having a radial extent less than a radial extent of the coil head and the coil body, the terminal convolution extending away from the coil head and coil body along a longitudinal axis of the coil, cavitated mattress pads positioned adjacent to the coil heads of each of the coils of the innerspring assembly to form a three layer structure including a first cavitated mattress pad adjacent one side of the innerspring assembly, and a second cavitated mattress pad adjacent an opposite side of the innerspring assembly, the cavitated mattress pads having a thickness dimension at least equal to an extent of the terminal convolution from the coil head along the longitudinal axis of the coil, and cavities in the cavitated mattress pad dimensioned and located to receive the terminal convolutions of the coil when placed adjacent to the coil heads of the innerspring assembly.

14. The mattress assembly of claim 13 wherein the cavities in the cavitated pads extend partially through the pads.

15. The mattress assembly of claim 13 wherein the cavities in the cavitated pads extend entirely through the pads.

16. The mattress assembly of claim 13 in combination with contoured secondary pads adjacent to the cavitated pads, the secondary pads having protrusions collocated with the cavities in the cavitated pads.

* * * * *